United States Patent [19]

Öbrink

[11] 4,262,465

[45] Apr. 21, 1981

[54] MOUNTED DEVICE FOR PANEL ELEMENTS, ESPECIALLY FOR BUILDINGS OR THE LIKE

[76] Inventor: Olof H. Öbrink, Promenaden 2, S-136 00 Kungsör, Sweden

[21] Appl. No.: 48,945

[22] Filed: Jun. 15, 1979

[30] Foreign Application Priority Data

Jun. 20, 1978 [SE] Sweden ..... 7807057

[51] Int. Cl.[3] ..... E04B 1/38

[52] U.S. Cl. ..... 52/510; 52/512; 52/482; 52/766

[58] Field of Search ..... 52/482, 510, 511, 512, 52/506, 766, 768, 764, 483

[56] References Cited

U.S. PATENT DOCUMENTS

| | | | |
|---|---|---|---|
| 2,553,363 | 5/1951 | Droeger | 52/483 X |
| 3,277,622 | 10/1966 | Jensen | 52/506 X |
| 3,295,284 | 1/1967 | Tschiesche | 52/483 |
| 3,628,298 | 12/1971 | Sichler | 52/483 X |
| 3,849,954 | 11/1974 | Sugita | 52/506 X |

FOREIGN PATENT DOCUMENTS

| | | | |
|---|---|---|---|
| 2542526 | 4/1977 | Fed. Rep. of Germany | 52/510 |
| 41776 | 10/1969 | Finland | 52/482 |

*Primary Examiner*—Price C. Faw, Jr.
*Assistant Examiner*—Carl D. Friedman
*Attorney, Agent, or Firm*—Pollock, Vande Sande & Priddy

[57] ABSTRACT

The invention relates to a mounting device for panel elements, especially for buildings and the like, which mounting device includes a number of mounting bars, which are mounted on the surface to be covered by the panel elements which are provided with a number of mounting ribs for cooperation with the mounting bars. The object is to provide a simple device of this kind, which device allows mounting without requirement for accurate alignment of the different details. This is accomplished in that each mounting bar carries a number of retaining members for cooperation with the mounting ribs. The retaining members are locked against movement perpendicularly to the longitudinal axis of the mounting bar but are freely slideable along the mounting bars to enable adjustment of the retaining members relative to the mounting ribs. Each retaining member includes two jaws facing each other, said jaws being directed outwardly at an angle to the mounting bar and at their outer ends being connected by means of a connecting member which defines an upwardly open and in the initial position of the jaws substantially trapezoidal recess, in which the mounting rib fits and which, when the panel element is pushed inwardly, closes around the mounting rib, so that the jaws retain the same.

8 Claims, 28 Drawing Figures

Fig. 6c
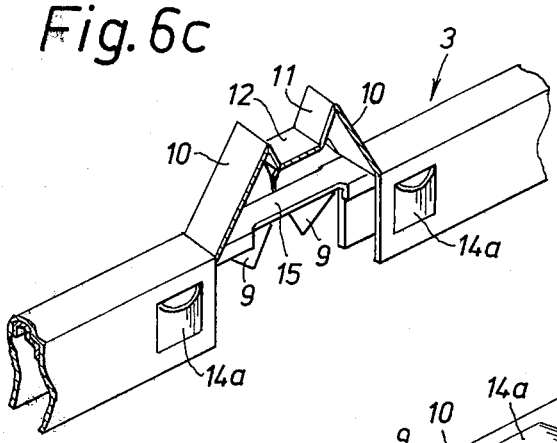
Fig. 7
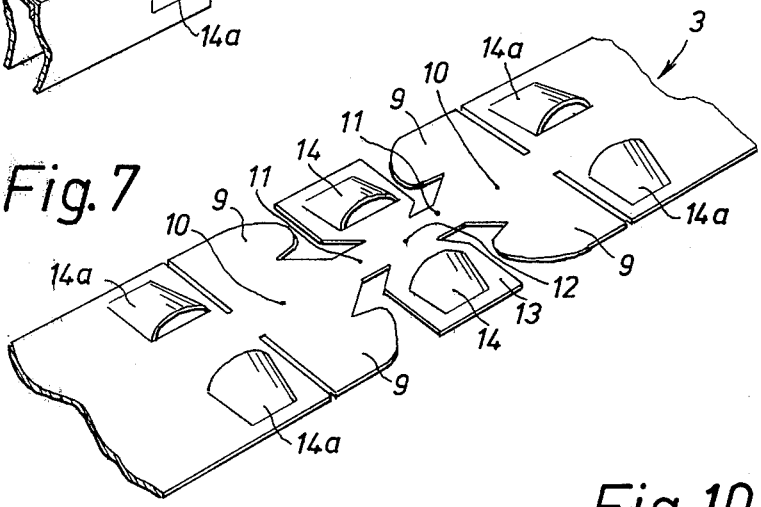
Fig. 10
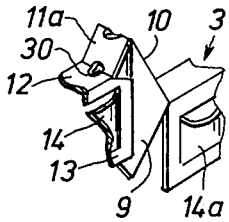
Fig. 9
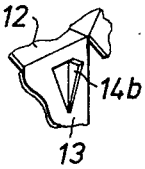
Fig. 8
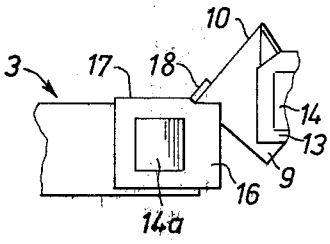
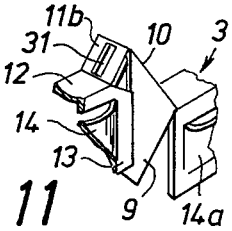
Fig. 11

Fig. 12a
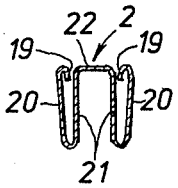
Fig. 12b
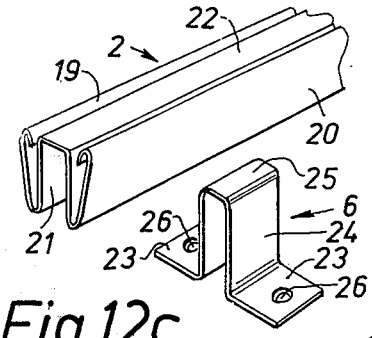
Fig. 12c
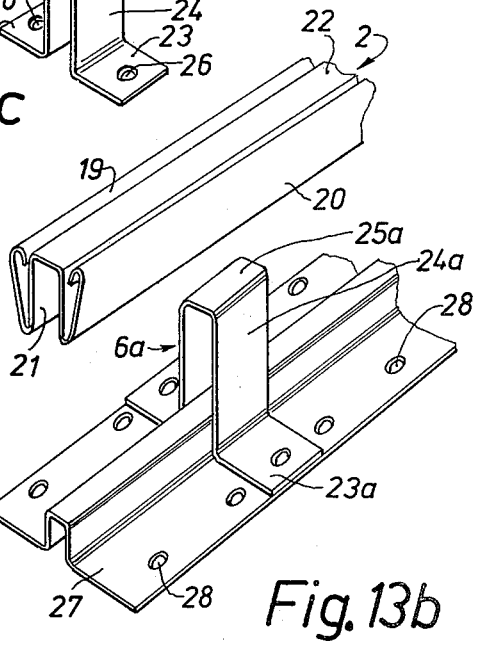
Fig. 13a
Fig. 13b
Fig. 14
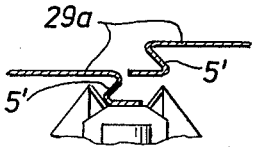
Fig. 15a
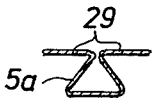
Fig. 15b
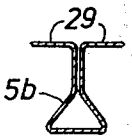
Fig. 15c
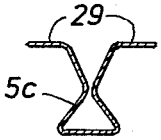
Fig. 15d
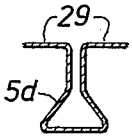
Fig. 15e
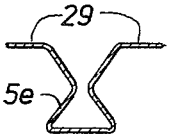
Fig. 15f
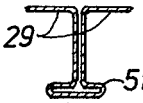
Fig. 15g
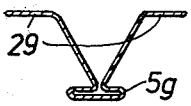
Fig. 15h
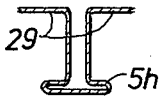
Fig. 15i
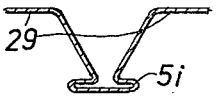

MOUNTED DEVICE FOR PANEL ELEMENTS, ESPECIALLY FOR BUILDINGS OR THE LIKE

BACKGROUND ART

The present invention relates to a mounting device for panel elements, especially for buildings, and including at least two spaced, substantially parallel mounting bars, which are mounted on the surface to be covered by the panel elements and which are arranged to carry at least one retaining member each, and mounting ribs which are connected to the panel elements and cooperate with the retaining members, said mounting ribs preferably extending across the panel elements and being arranged at an angle relative to the mounting bars and having a cross section enabling the retaining members to cooperate with any portion of the mounting rib to retain the same.

In many cases it is desirable to mount panel elements on a surface, e.g. a facade of a building in connection with construction or renovation of the facade, possible together with additional insulation. For this purpose elements of different shapes and different materials, e.g. plastics, steel, aluminum alloys or the like, are used. A usual way to mount these elements is to arrange mounting bars on the supporting surface, whereupon the elements are mounted to the mounting bars by means of separate anchoring means. Alternatively the mounting bars are provided with stationary hooks, on which the elements are supported, the elements usually being connected to each other by means of further hooks. In this last mentioned type of device it is required in order to obtain a satisfactory result that the mounting bars are aligned very carefully, both relative to the supporting surface and relative to each other. Also when using separate anchoring means special care is to be taken when flat or sheet shaped elements are to be mounted, when the mounting bars must be adjusted relative to the edges of the elements, where the anchoring means are applied. Naturally, this is both time-consuming and expensive.

Another disadvantage of previously known systems for mounting of panel elements is that the distance between the anchoring means or the hooks cannot be increased above a predetermined value unless the panel elements, especially if they are made of sheet metal, are provided with some form of further stiffening means or, if the elements are of a flat type, the thickness is increased. In order to increase the distance between the anchoring means it is therefore necessary to increase the amount of material in the panel elements, which naturally means increased costs.

SUMMARY OF THE INVENTION

An object of the present invention is to provide a mounting device for panel elements, especially for buildings and the like, said mounting device removing the disadvantages mentioned above and enabling simple mounting of panel elements, which may be of any desired configuration, whereby the mounting bars may be mounted with the desired spacing and without accurate alignment relative to each other or relative to the panel elements. According to the present invention this is accomplished substantially in that the retaining members are locked against movement perpendicularly to the longitudinal axis of the mounting bar, in that at least most of the retaining members are freely slidable along the mounting bars to enable adjustment of the retaining members relative to the mounting ribs, and in that each retaining member includes two jaws facing each other, said jaws being bent outwardly at an angle to the mounting bar and at their outer ends being connected by means of a connecting member, which is bent to define an upwardly open and in the initial position of the jaws substantially trapezoidal recess, in which the mounting rib fits and which, when the panel element is pushed inwardly, closes around the mounting rib, so that the jasw retain the same.

BRIEF DESCRIPTION OF THE DRAWINGS

The invention is described in detail below with reference to the accompanying drawings, on which.

FIGS. 6*a*, 6*b* and 6*c* show a retaining member in the device according to FIGS. 1–5 with various details broken away;

FIG. 7 shows the retaining member according to FIG. 6 in developed position;

FIG. 8 shows another embodiment of a portion of the retaining member according to FIG. 6;

FIGS. 9–11 show alternative embodiments of details of the retaining member according to FIG. 6;

FIGS. 12*a* and 12*b* show a sectioned and a perspective view, respectively, of a portion of a mounting bar according to FIGS. 1–5;

FIG. 12*c* shows a mounting member for mounting the mounting bar of FIGS. 12*a* and 12*b* to a support surface;

FIGS. 13*a* and 13*b* show a mounting bar according to FIGS. 1–5 and an alternative embodiment of a mounting member for the mounting bar, respectively;

FIG. 14 shows an embodiment of the edges of two panel elements; and

FIGS. 15*a*–15*i*

DETAILED DESCRIPTION OF THE PREFERRED EMBODIMENT

Figure 1:
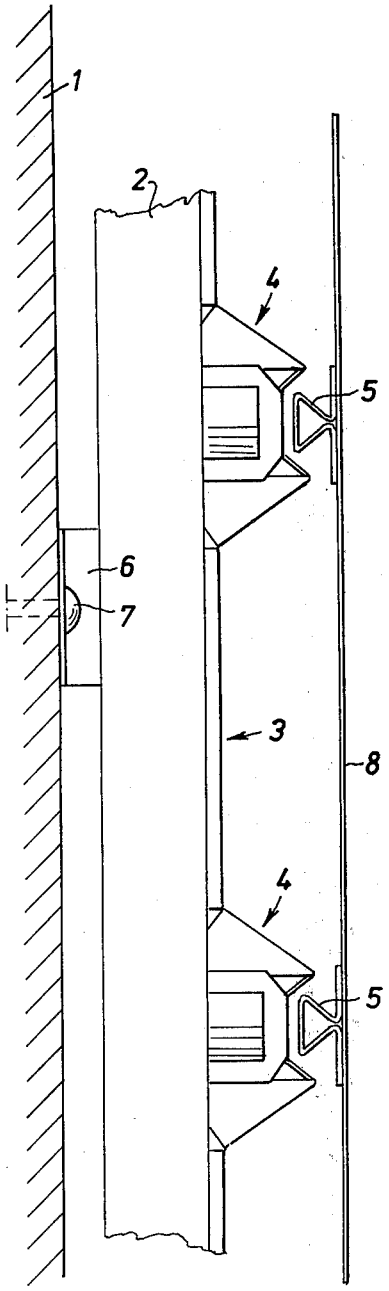
FIG. 1 is a side elevation of part of a mounting device according to one embodiment of the invention with a panel element in position for mounting.
Figure 2:
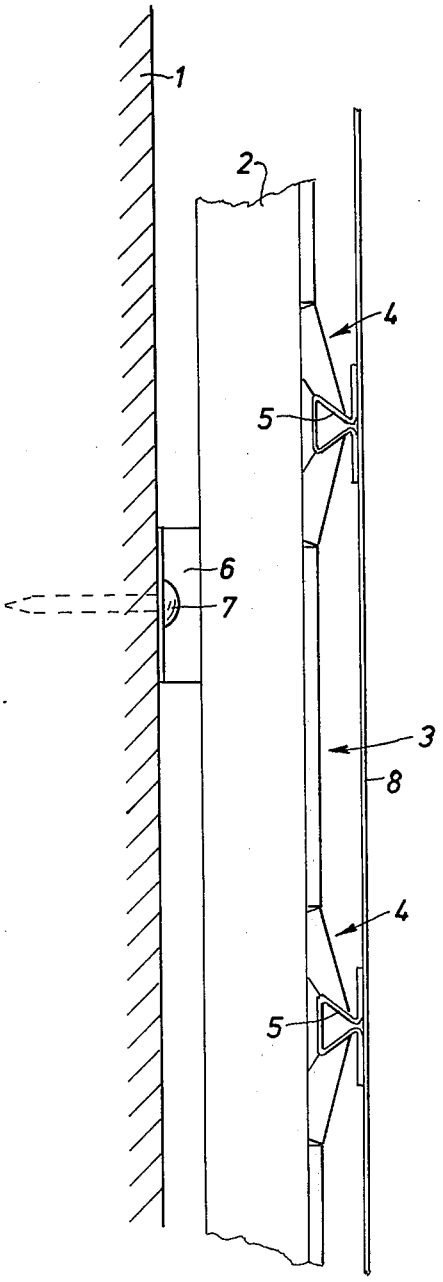
FIG. 2 is an elevation corresponding to FIG. 1 but with the panel element in mounted position.

In FIGS. 1 and 2 a mounting device according to the present invention is shown mounted on a support surface, which in this case is a wall 1. The mounting device includes a number of substantially parallel mounting bars 2 of which only one is shown on the drawing, and for each mounting bar a retaining bar 3 with a number of retaining members 4, which are intended to cooperate with mounting ribs 5 on a panel element 8. Each mounting bar 2 is mounted to the support surface 1 by means of mounting members 6, which are provided with openings for fastening means such as nails 7, screws or the like.

In FIGS. 6*a*–*c* and 7 is shown the design of a portion of the retaining bar 3 with a retaining member 4. As is shown in FIGS. 6 the retaining bar 3 is substantially U-shaped with the web portion positioned outwardly from the support surface 1. In order to produce the retaining member 4 the flanges of the retaining bar 3 are slotted, so that two jaws having flanges 9 and web portions 10 are produced, said jaws facing each other. When the web portion 10 of the jaws are in the initial position inclined upwardly towards each other, their upper ends are connected to each other by connecting means in the shape of web portions 11 and 12, which together define an upwardly open and substantially trapezoidal recess for cooperation with a mounting rib 5 of a panel element 8. The web portions 11 constitute alignment means in order to facilitate the mounting of the panel element 8. From the bottom of the upwardly open recess, tongues 13 extend downwardly in the same direction as the flanges of the retaining bar 3. These tongues and also the ends of the flanges of the retaining bar 3 adjacent the retaining member 4 are provided with locking elements in the shape of punched out portions 14 and 14*a*, respectively the function of which is described in more detail below. As can be seen from FIG. 7 the retaining bar 3 and the retaining members 4 may be made in one piece from band or sheet shaped material, which is punched and bent to the desired configuration. In order to keep each retaining member 4 in the desired position and to provide the desired mutual movement between the different portions when the panel element 8 is mounted, a distance bar 15 is arranged within the retaining bar 3 in contact with the web portion of the same. The distance bar 15 is rigidly connected to the retaining bar 3, e.g. by spot welding, and preferably has an inverted U-shape, whereby the flanges preferably are cut away at each retaining member 4.

In FIG. 8 an alternative embodiment of the connection between the retaining bar 3 and the retaining member 4 is shown. In this embodiment the retaining bar 3 is provided with a rigidly mounted, substantially U-shaped member having flanges 16 and a web portion 17. Thereby the flanges 16 are provided with locking elements 14*a*, and at its end adjacent to the retaining member 4 the web portion 17 is provided with an upturned extension 18 which is intended to be an extra support means for the retaining member 4 and to prevent the retaining member 4 from coming loose even if the connection between the retaining member 4 and the retaining bar 3 is broken, e.g. as a consequence of fatigue in material.

In FIG. 9 there is shown an alternative embodiment of the locking elements 14*b*, which in this embodiment comprise punched out and turned out tongues. In FIGS. 10 and 11 there is shown how different types of openings 30 and 31 may be provided in the web portions 11*a* and 11*b*, respectively.

In FIGS. 12*a*, 12*b* and 12*c* there is shown the structure of the mounting bar 2. As can be seen especially in FIG. 12*a* the mounting bar 2 has substantially a reversed U-shaped cross section having flanges 21 and a web portion 22, and the flanges are provided with substantially 180° folded portions 20, which at their free ends are provided with inturned end portions 19. In FIG. 12*c* there is also shown the mounting members 6, which has inverted U-shaped cross section having a web portion 25, flanges 24 and outwardly turned edge portions 23, said edge portions being provided with mounting openings 26. The mounting member 6 has a width to fit within the mounting bar 2.

In FIG. 13*b* there is shown an alternative embodiment of a mounting member 6*a* for the mounting bar 2. The mounting member 6*a* has a web portion 25*a*, flanges 24*a* and outwardly turned edge portions 23*a* which are rigidly connected to a mounting strip 27 having mounting openings 28.

Figure 3:
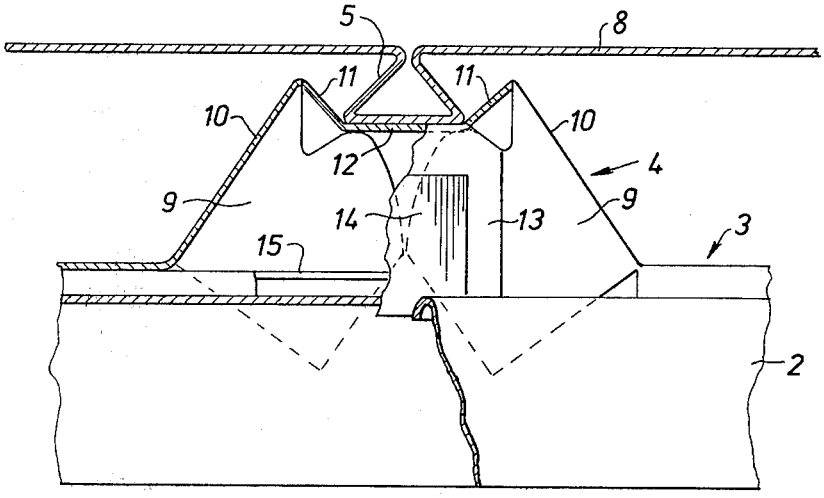
FIG. 3 is a partially sectioned elevation of a retaining member in the mounting device according to FIG. 1 with a panel element in position for mounting.
Figure 4:
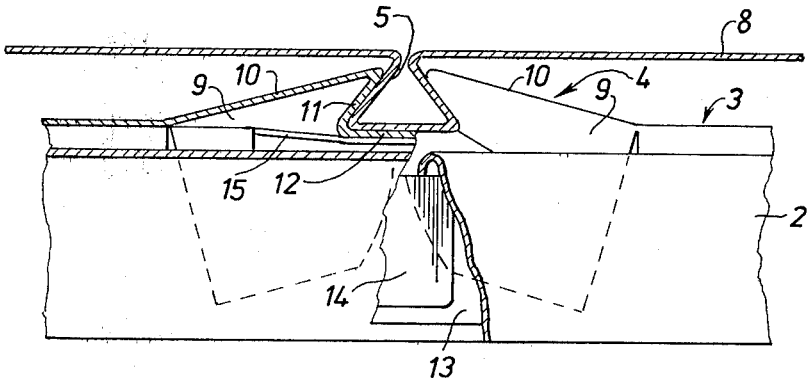
FIG. 4 is an elevation corresponding to FIG. 3 but with the panel element in mounted position.
Figure 5:
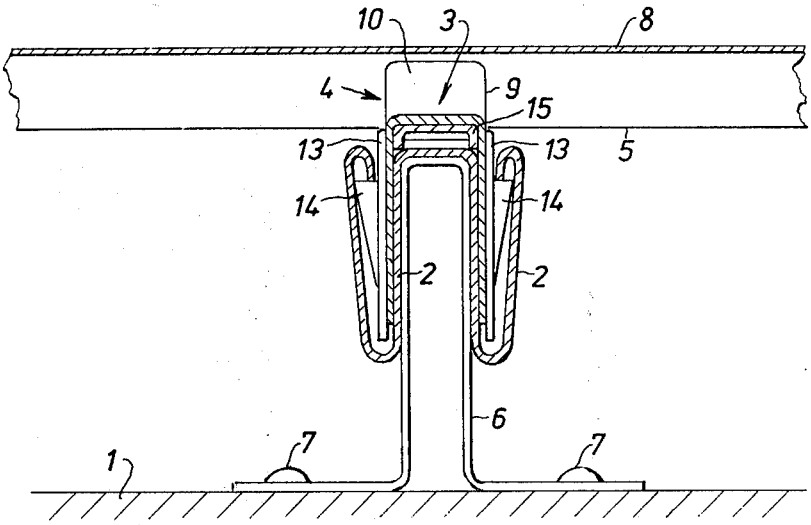
FIG. 5 shows a section through the device according to FIG. 4.
Figure 6A:
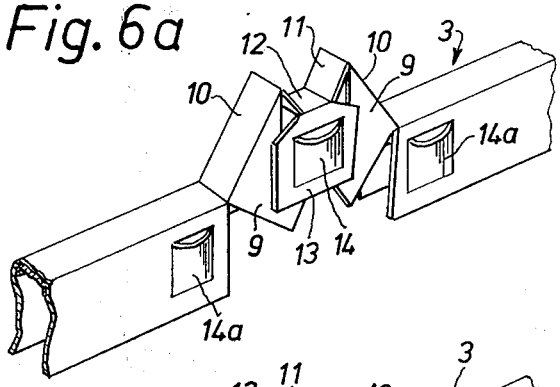
Figure 6B:
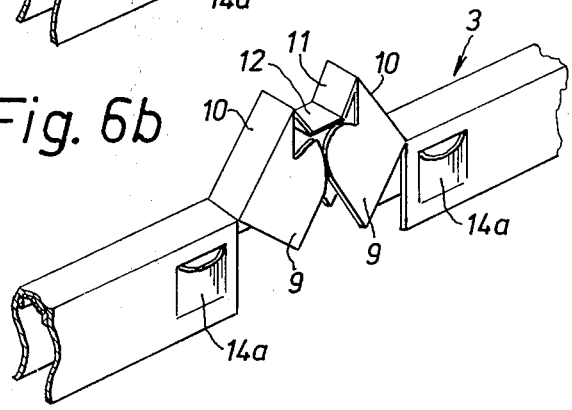

In FIGS. 3–5 there is shown in more detail the mounting of a panel element 8 having a mounting rib 5 of substantially triangular cross section. In the initial position the details are placed as shown in FIG. 3. The mounting rib 5 is in the shown embodiment made integrally with the panel element 8. In the initial position one side of the mounting rib 5 is in contact with the web portion 12 of the upwardly open recess in the retaining member 4. When a pressure is applied to the outside of the panel element 8 this will move the panel element and the mounting rib 5 downwards, as seen in FIGS. 3–5, to the position shown in FIG. 4. Thereby the mounting rib 5 is guided to its correct position by means of the web portions 11 and 12, whereby the jaws of the retaining member 4 are pivoted downwards, so that they come into contact with the side portions of the mounting rib 5 to securely retain the same. When the position according to FIG. 4 is reached the locking elements 14 and 14*a* will further snap in behind the inturned edge portions 19 of the mounting bar 2, so that the retaining member 4 is locked in the position shown in FIG. 4. Thereafter the mounting rib 5 is securely retained by the retaining member 4.

In order to achieve an appropriate retaining effect of the edges of two panel elements 8, the edge portions 29*a* of these panel elements may be shaped, as shown in FIG. 14, with edge portions 5*b*′ which together have triangular cross section, so that they may be mounted in the retaining member 4 in the manner described above. However, it is not necessary to secure the edges of the panel elements, but the mounting may be made only by means of the mounting ribs 5 on the inside of the panel elements 8.

In FIGS. 15*a–c* there are shown a number of different embodiments of mounting ribs. All these mounting ribs may be used together with retaining members 4 of the kind described above, and all these mounting ribs may be made either integrally with the panel elements 8 or as separate details which are mounted on the panel elements 8. However, in all cases the mounting ribs have several functions. Firstly they are used for mounting of the panel elements 8, secondly they give a distribution of stresses and a stiffening of the elements, and thirdly they may be used to press an additional insulation against the supporting surface at the same time as they give air slots for ventilation.

The invention is not limited to the embodiments described above, but changes may be made within the scope of the attached claims.

It is e.g. possible to cancel the tongues 13 and replace them with short extensions, whereby a separate, U-shaped clamp having locking elements in its flanges and an opening in its web portion is positioned over the web portion 12 with the short extensions extending through the opening and bent against the flanges of the clamp to retain the clamp in position.

I claim:

1. A mounting device for panel elements, especially for buildings, and comprising:

at least two spaced, substantially parallel mounting bars, which are mounted on the surface to be covered by the panel elements and which are arranged to carry at least one retaining member each, and mounting ribs which are connected to the panel elements and cooperate with the retaining members, said mounting ribs preferably extending across the panel elements and being arranged at an angle relative to the mounting bars and having a cross section enabling the retaining members to cooperate with any portion of the mounting rib to retain the same, characterized in that the retaining members are locked against movement perpendicularly to the longitudinal axis of the mounting bar, in that at least most of the retaining members are freely slideable along the mounting bars to enable adjustment of the retaining members relative to the mounting ribs, and in that each retaining member includes two jaws, facing each other, said jaws being directed outwardly at an angle to the mounting bar and at their outer ends being connected by means of a connecting member which defines an upwardly open and in the initial position of the jaws substantially trapezoidal recess, in which the mounting rib fits and which, when the panel element is pushed inwardly, closes around the mounting rib, so that the jaws retain the same.

2. A mounting device according to claim 1, wherein the retaining members carried by the same mounting bar are made integral with a retaining bar having a substantially U-shaped cross section, the jaws comprising portions of the retaining bar, the flanges of which are slotted and the web portion of which comprises the connecting members.

3. A mounting device according to claim 1 or 2, wherein the retaining members are connected to a distance bar which is intended to keep the jaws at a predetermined distance from each other.

4. A mounting device according to claim 3, wherein the distance bar is provided with punched out locking elements arranged to snap in behind turned in edge portions of the mounting bar, thereby locking said distance bar against outward movement from the mounting bar.

5. A mounting device according to claim 3, wherein the retaining bar and the distance bar are locked against outward movement from the mounting bar in that it is provided with punched out locking elements which are arranged to snap in behind turned in edge portions of the mounting bar.

6. A mounting device according to claim 5, wherein the connecting members are provided with inwardly directed tongues which are provided with punched out locking elements which are arranged to snap in behind turned in edge portions of the mounting bar when the jaws are in a retaining position.

7. A mounting device according to claim 6, wherein the facing edges of two adjacent panel elements combine to form a mounting rib for cooperation with one or more of the retaining members.

8. A mounting device according to claim 6, wherein each mounting bar is mounted on the surface to be covered by the panel elements by means of at least two spaced mounting members.

* * * * *